US007976682B2

(12) United States Patent
Bechard

(10) Patent No.: US 7,976,682 B2
(45) Date of Patent: Jul. 12, 2011

(54) HINGED SCREEN PLATE FOR DRUM PULP WASHER AND METHOD FOR CLEANING THE PLATE

(75) Inventor: Grant Bechard, Queensbury, NY (US)

(73) Assignee: Andritz Inc., Glens Falls, NY (US)

( * ) Notice: Subject to any disclaimer, the term of this patent is extended or adjusted under 35 U.S.C. 154(b) by 59 days.

(21) Appl. No.: 12/565,060

(22) Filed: Sep. 23, 2009

(65) Prior Publication Data

US 2010/0071864 A1 Mar. 25, 2010

Related U.S. Application Data

(60) Provisional application No. 61/099,231, filed on Sep. 23, 2008.

(51) Int. Cl.
*D21G 3/00* (2006.01)

(52) U.S. Cl. ..... 162/272

(58) Field of Classification Search ..... 162/272, 162/199; 210/402

See application file for complete search history.

(56) References Cited

U.S. PATENT DOCUMENTS

| | | | |
|---|---|---|---|
| 2,963,158 | A | 12/1960 | Jung |
| 3,363,770 | A | 1/1968 | Glos, II |
| 4,276,169 | A | 6/1981 | Browne et al. |
| 4,827,741 | A | 5/1989 | Luthi |
| 5,046,338 | A | 9/1991 | Luthi |
| 5,460,019 | A | 10/1995 | Ojala et al. |
| 5,766,466 | A | 6/1998 | Peterson |
| 6,006,554 | A | 12/1999 | Gallagher |
| 6,461,473 | B1 | 10/2002 | Qvintus et al. |
| 6,789,285 | B1 | 9/2004 | Haapamaki |
| 7,575,658 | B2 | 8/2009 | Grace |
| 2008/0087391 | A1 | 4/2008 | Grace |

*Primary Examiner* — Mark Halpern
(74) *Attorney, Agent, or Firm* — Nixon & Vanderhye P.C.

(57) ABSTRACT

A pulp washer including: a cylindrical assembly of trays to receive pulp, wherein the assembly rotates the trays through at least one wash stage; a housing having a header to direct pulp to the trays and the at least one wash stage, wherein the housing has at least one access port aligned with one or more of the trays; a screen plate in each tray of the assembly, wherein the screen plate has apertures sized to retain pulp fibers and allow liquid to pass through the plate, and a screen hinge attached to a side edge of the screen plate and to the tray, wherein the screen plate pivots about the hinge to allow a cleaning spray to be applied to an outer screen plate surface and a back screen plate surface.

13 Claims, 4 Drawing Sheets

HINGED SCREEN PLATE FOR DRUM PULP WASHER AND METHOD FOR CLEANING THE PLATE

RELATED APPLICATION

Priority is claimed to U.S. Provisional Patent Application Ser. No. 61/099,231, filed on Sep. 23, 2008, the entirety of which is incorporated by reference.

BACKGROUND OF THE INVENTION

The present invention relates to pulp washing systems and, particularly, to a method and apparatus for periodically cleaning screens in a drum pulp washing system.

Drum washers are used in various fiberline process stages to displace high solids filtrate from pulp stock. A drum displacement washer, such as the Drum Displacer® (DD) Washer supplied by Andritz Oy of Finland, is typically a pressurized multistage washer. A DD Washer includes a rotating drum having rows of trays filled with pulp as wash liquid is sprayed on the trays. The wash liquid passes through the pulp in the tray and removes chemicals and filtrate from the pulp. Screens in the bottom of the trays allow the wash liquid to pass through the trays and retain the pulp in the trays.

The screens may clog and corrode due to the pulp fibers retained by the screens and the flow of wash liquid, chemicals and filtrate through the screens. The screens are periodically cleaned to open clogged screen slots and remove corrosion on the screens. The screens are cleaned while the drum is stopped and the washer undergoes maintenance.

Cleaning both sides of conventional screens typically requires the screens to be removed from the tray by sliding the screen from the end of the tray. Accessing the ends of the trays to remove the screens is difficult due to the housing encasing the drum. Cleaning of the screens is typically a time consuming operation because of the difficulty in removing and replacing screens from the axial ends of the trays. Alternatively, the screens are partially cleaned by spray washing the upper surface of the screens. This alternative spray washing technique does not spray the bottom surfaces of the screens. This alternative spray washing technique is performed quickly and, thus, has advantages over cleaning by removing the screens. However, the alternative spray washing technique does not clean the bottom of the screens. Accordingly, there is a long felt need for an improved system and method to clean both sides of the screens in the trays of a pulp washer.

BRIEF DESCRIPTION OF THE INVENTION

A pulp washer is disclosed herein comprising: a cylindrical assembly of trays to receive pulp, wherein the assembly rotates the trays through at least one wash stage; a housing having a header directing pulp to the trays and at least one wash stage, wherein the housing has an access port aligned with one or more of the trays; a screen plate in each tray of the assembly, wherein the screen plate has apertures sized to retain pulp fibers and allow liquid to pass through the plate, and a screen hinge attached to a side edge of the screen plate and to the tray, wherein the screen plate pivots about the hinge to allow a cleaning spray to be applied to opposites sides of the screen plate during a screen cleaning operation.

A method is disclosed herein to clean a screen plate in a tray of a cylindrical assembly of pulp receiving trays in a housing of a pulp washer, the method comprising: cleaning a first surface of the screen plate by spraying a wash solution while the screen plate remains seated in the tray; pivoting the screen plate about a hinge between the screen plate and the tray to expose to the spray of the wash solution an opposite surface of the screen plate, and cleaning the opposite surface of the screen plate with the wash solution while the screen plate remains attached to the tray.

DETAILED DESCRIPTION OF THE INVENTION

Figure 1:
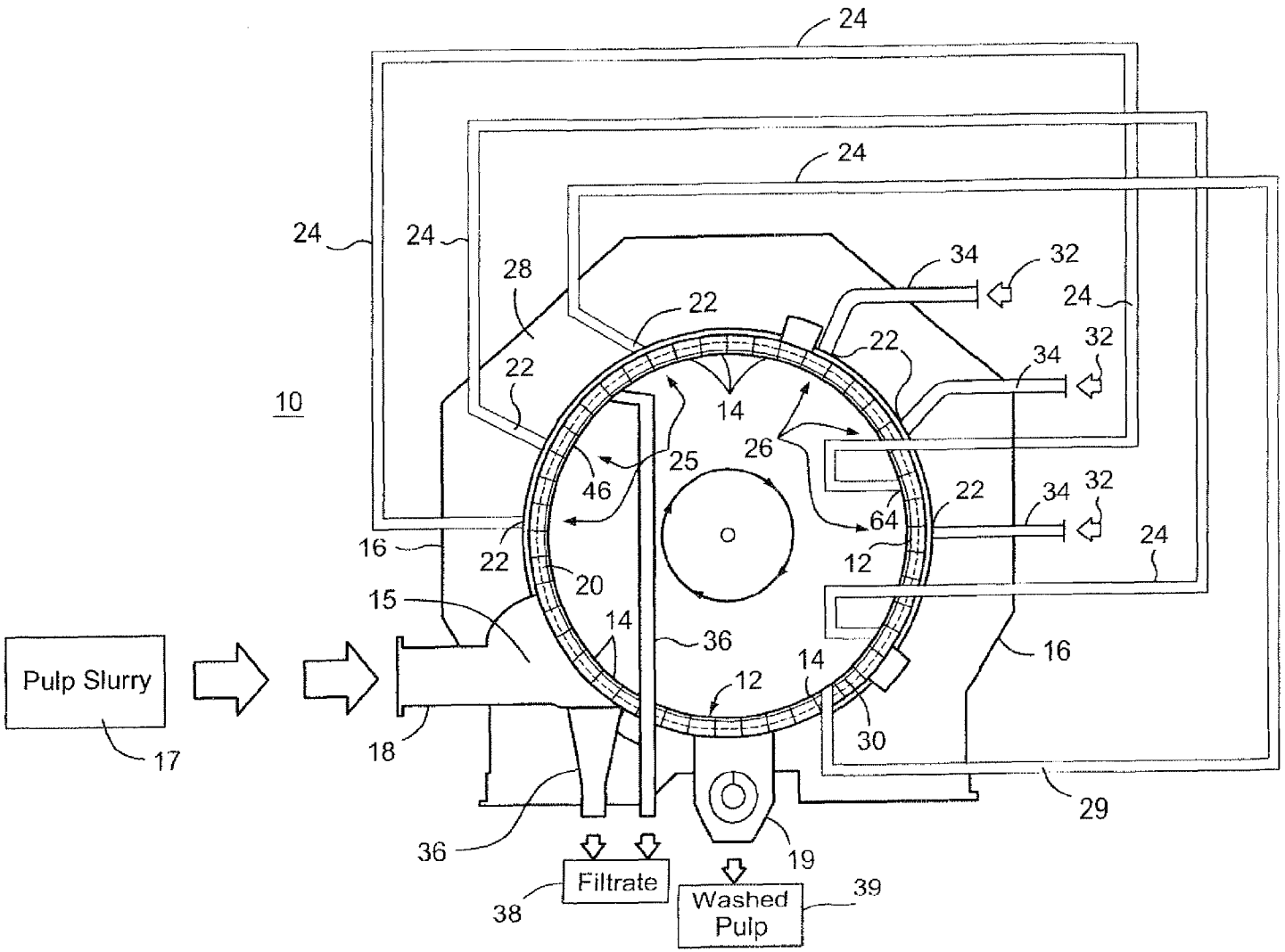
FIG. 1 is a schematic diagram showing in cross-section a pulp washer.

FIG. 1 is a cross-sectional view of a Drum Displacer® (DD) Washer 10, supplied by Andritz Oy of Finland. The DD Washer is a pressurized multistage washer that has, for example, four washing stages. The DD Washers may be used in various fiberline process stages to separate waste liquor from pulp stock during a paper forming operation. The waste liquor may include bleach or other chemicals used to process the pulp stock. The waste liquor may be generated during chemical cooking in a digester and contain dissolved wood and chemicals from the pulp stock.

As shown in FIG. 1, the DD washer includes a cylindrical assembly 12, e.g., drum, of trays 14 that slowly rotate within a housing 16. The cylindrically assembly 12 continuously rotates as indicated by the circle shown at the center of the cylindrical assembly 12. The circle of rotation is divided into zones, for purposes of illustration. In a pulp loading zone 15 at about the 7 o'clock position on the cylindrical assembly, the trays receive pulp from a pulp slurry 17 flowing in through a head box 18. In the wash zone 20, wash liquid is sprayed on the pulp in the trays. In a discharge zone, the washed pulp falls from the trays as "pulp bricks" to a repulper 19 which discharges the pulp bricks from the washer 10.

In the wash zone 20, wash liquid is sprayed from nozzles 22 to the pulp in the trays. The wash zone has wash stages. Certain early wash stages 25 apply wash liquid recycled from subsequent stages to the pulp in the trays. The last stage(s) 26 applies clean wash liquid.

In each wash stage, wash liquid flows to nozzles from a first wash liquid conduit 24 receiving wash liquid that has passed through trays in a subsequent wash stage(s). As the assembly 12 rotates, the trays move past each of the wash stages. The wash liquid used in the second wash stage may be wash liquid recovered via conduits 24 from the last wash stage 26 and is cleaner than the wash liquid sprayed in the first wash zone. Clean wash liquid 32, such as water, flows through conduits 34 to the trays passing through a clean liquid wash stage(s) 26. The wash liquid recovered from the trays in the initial wash stages 25 may pass through filtrate conduits 36 internal to the cylindrical assembly and head box, and to a filtrate recovery system 38.

Figure 2:
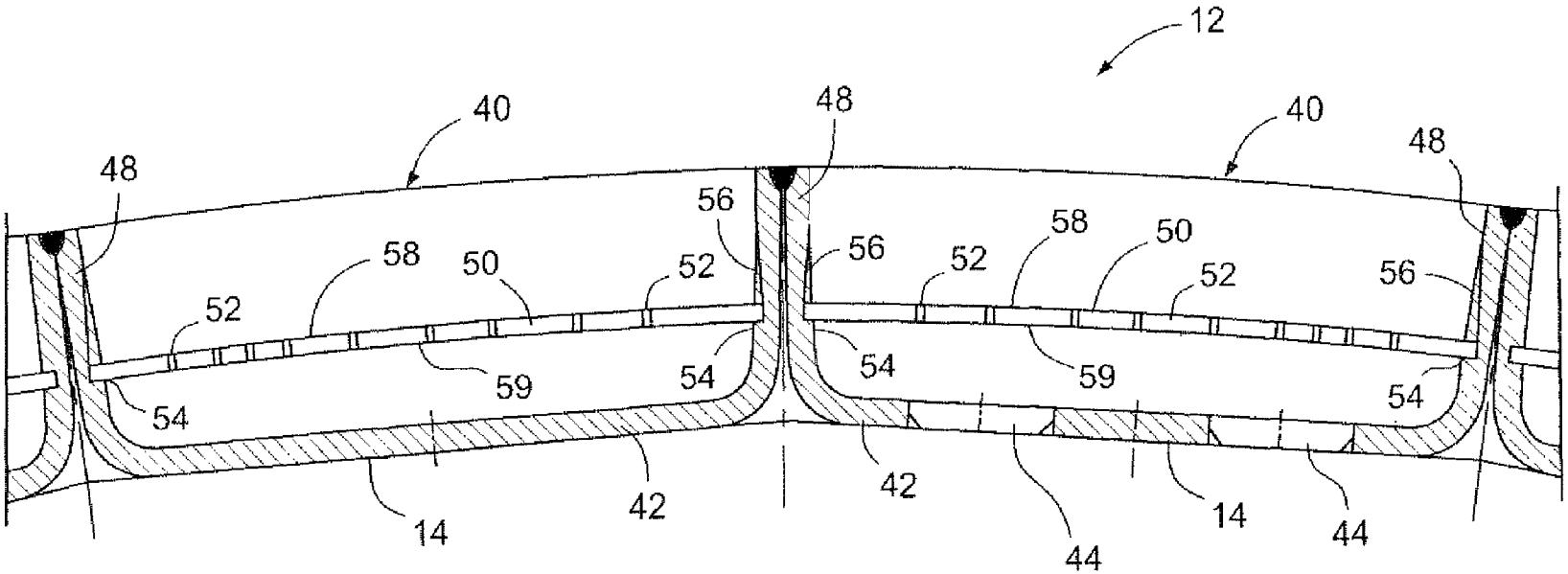
Fig. 2 (Prior Art)
FIG. 2 is an enlarged view of the screen plates inserted in the trays, where the plates are conventional plates that slide in an axial direction into the trays.

FIG. 2 is a cross-sectional view of two trays 14 in the cylindrical assembly of trays 12. The trays are generally close ended channels having an open face 40 facing radially outward from the assembly. The trays have a generally solid bottom 42 with openings 44 to allow wash fluid to flow from the tray to a manifold 46 or filtrate conduit 36 (FIG. 1). The trays are attached to adjacent tray so that the trays are arranged side-by-side at the periphery of the cylindrical assembly 12.

As the pulp slurry enters the open face of the tray 14 from the head box, pulp fills the tray and much of the liquid from slurry passes through a screen plate 50 near the bottom 42 of the tray. The screen plate has small slots 52 or other openings through which passes liquid rotates. The slots are too small to allow the passage of the fibers and other solids in the pulp. The screen plates are typically rectangular metal plates, e.g., steel, that are seated on ledges 54 on the sidewalls 48 of the trays.

Conventionally, each screen plate is inserted longitudinally into a lateral end of a tray. After being slid into the tray and seated on the ledges 54, a bracket 56 is attached to the tray sidewall immediately above the edge of the screen plate and secures the screen plate in the tray. Inserting the conventional screen plate laterally requires that an end of a tray be accessible through an opening in the housing of the DD washer. The housing conventionally has a small access port in a side through which a single screen plate can be removed and inserted. To remove a screen plate through the access port in the housing requires the cylindrical assembly be turned to align the end of the tray with the access port. Removing and inserting screen plates laterally is time consuming and difficult, and does not provide easy or open access to the screens after being inserted in the tray.

Conventionally, screen plates have been cleaned by high pressure sprays applied to an upper surface 58 of the screen plate while the plate remains in the tray or by removing the plates from the tray and applying a caustic bath or acid wash to the removed plates. Due to the difficulty in removing the screen plates, they are conventionally not removed when the high pressure spray is applied to the upper surface of the screen plate. The high pressure sprays are not applied to the back surface 59 of the plate which faces the bottom of the tray.

Figure 3:
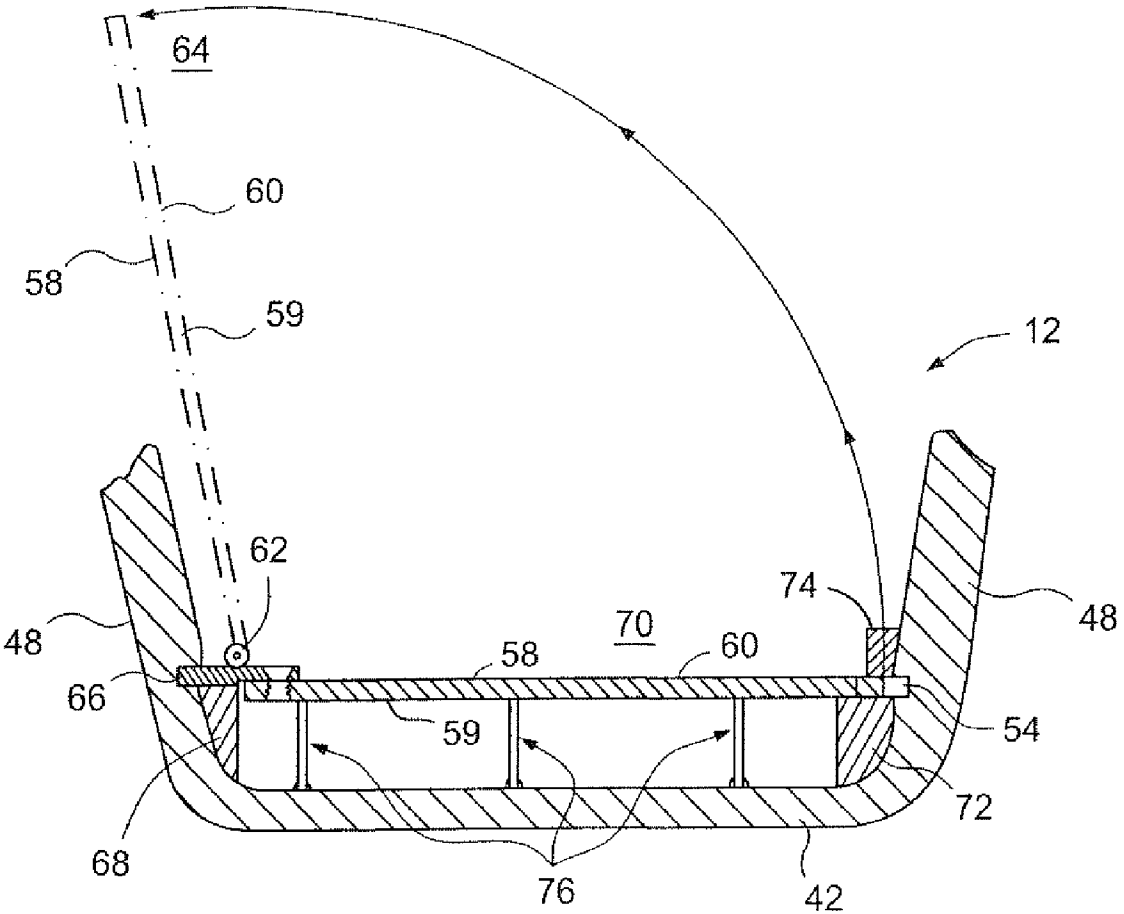
FIG. 3 is an enlarged side view of the inventive screen plates inserted in the trays, where the plates are hinged to the tray.

FIG. 3 is a cross-sectional schematic diagram of a tray 12 having a screen plate 60. A hinge 62 allows the screen plate to be pivoted (see open plate position 64) to allow the back surface 59 of the plate to be washed with a high pressure cleaning spray. The hinge 62 is mounted to a sidewall 48 of the tray. A bracket 66 for the hinge may be attached to a lower portion of a sidewall 48. The bracket may include a rib 68 or other support for the hinge and screen plate. The side of the hinge opposite to the bracket is attached, e.g., welded or bolted, to the screen plate 60. The hinge may be a continuous cylindrical structure extending the length of the side edge of the screen plate or a series of hinge assemblies spaced at intervals along the side edge of the screen plate.

When the screen plate is in the open position 64, the back surface 59 of the plate is exposed and a high pressure cleaning spray may be applied to remove corrosion, scale and debris from the back of the screen plate and its slots. The outer surface 58 of the screen plate can be cleaned with the same cleaning spray when the screen plate is in a closed position 70. After impinging on the surfaces 58, 59 of the screen plate, the cleaning spray and removed corrosion, scale and debris may flow out of the tray such as into and through the filtrate conduits 36 to the repulper 19.

When the screen plate 60 is in the closed position 70, the side edge of the plate opposite to the hinge 62 is seated on a ledge in the opposite tray sidewall 48 or a stop piece 72 attached to the lower portion of the opposite sidewall. A bracket 74 may be attached to the sidewall 48 and immediately above the edge of the plate to secure the plate in the closed position 70. The screen plate in the closed position 70 may also be supported by one or more ribs 76 extending upward from the bottom 42 of the tray and to the bottom surface 59 of the screen plate. The ribs are attached to the bottom of the tray to support the screen plate, but may not be fixed to the plate.

Figure 4:
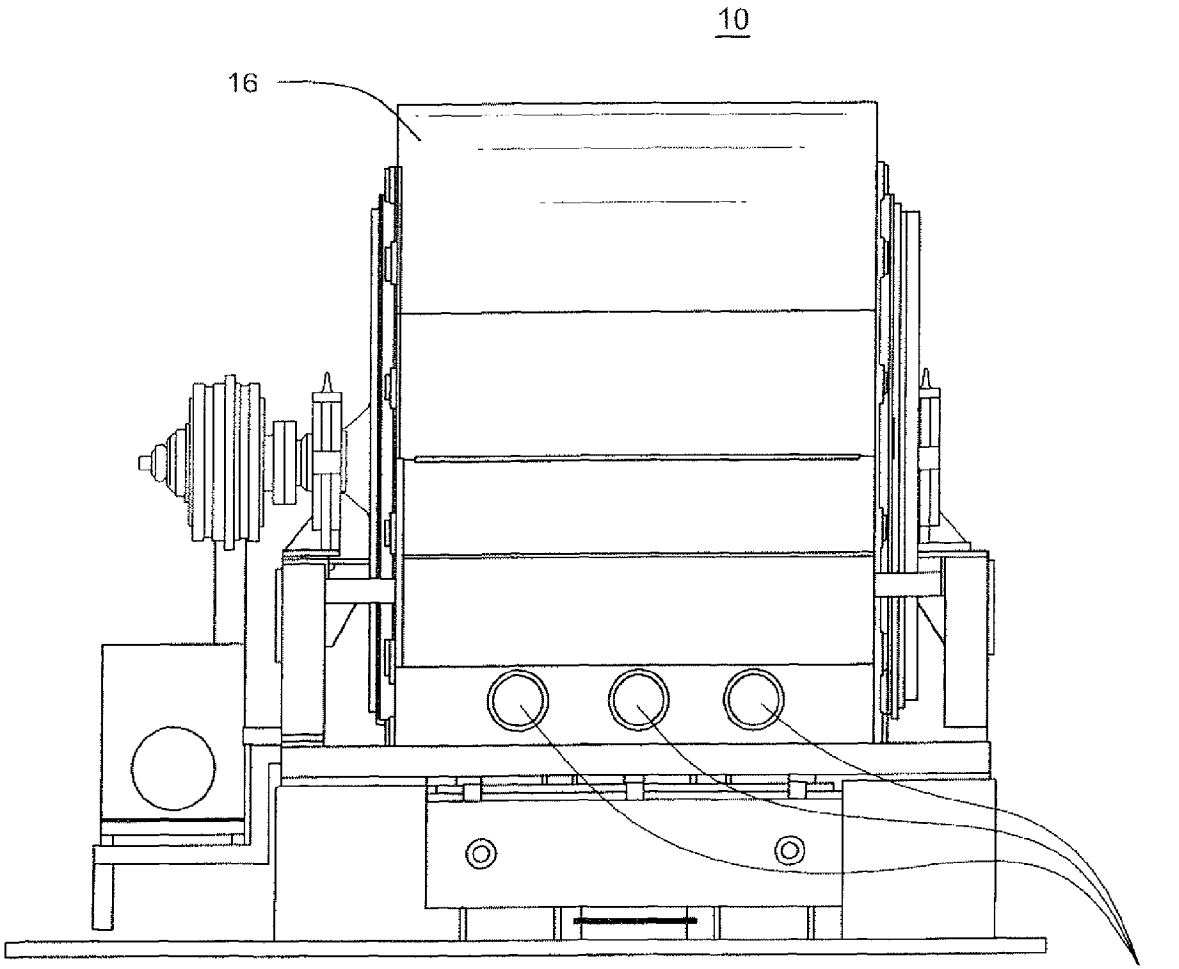
Fig. 4 (Prior Art)
FIG. 4 is a side view of a conventional pulp washer showing inspection ports through which the screen plates may be accessed for cleaning.

FIG. 4 is a side view of a conventional DD washer 10. The side of the washer housing has multiple access ports 80 that may each be four to six feet in diameter. These ports 80 are conventionally used for inspection of the trays and the cylindrical tray assembly. These ports 80 may be used to access the trays and apply a cleaning spray to the outer surfaces and back surfaces of the screen plate(s) aligned with the ports. By pivoting the screen plate about the hinge 62, both surfaces of the screen plate may be cleaned while the screen plate remains attached (at the hinge) to the tray. It is not necessary to remove the screen plate to clean both sides of the plate. After cleaning, the plates are moved to the closed position 70 and secured to the sidewall of the trays. To clean additional screen plates, the cylindrical assembly 12 is rotated to align the additional plates with the access ports 80.

Preferably, two or more trays are cleaned via the access ports 80 while the cylindrical assembly 12 is stationary. A typical cylindrical assembly is four meters in diameter and has thirty-six (36) rows of trays. Being able to clean the screen plates in two or more rows of trays at each stationary position of the cylindrical assembly allows for a relatively fast cleaning operation on all of the screen plates.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A pulp washer comprising:

a cylindrical assembly of trays to receive pulp, wherein the assembly rotates the trays through at least one wash stage;

a housing having a header to direct pulp to the trays and the at least one wash stage, wherein the housing has at least one access port aligned with one or more of the trays;

a screen plate in each tray of the assembly, wherein the screen plate has apertures sized to retain pulp fibers and allow liquid to pass through the plate, and a screen hinge attached to the screen plate and a tray in which the plate is seated, wherein the screen plate pivots about the hinge to allow a cleaning spray to be applied to an upper screen plate surface and a back screen plate surface.

2. The pulp washer in claim 1 wherein the screen hinge is attached to a side of the tray.

3. The pulp washer in claim 1 wherein the screen hinge is attached proximate to an edge of the screen plate.

4. The pulp washer in claim 3 wherein the edge of the screen plate extends a length of the screen plate.

5. The pulp washer in claim 1 further comprising a plurality of support ribs extending between a bottom surface of the tray and the back screen plate surface.

6. The pulp washer in claim 1 further comprising a stop piece at a side of the tray opposite to the hinge, wherein the stop piece abuts the back screen plate surface.

7. The pulp washer in claim 1 further comprising a bracket attached to a side of the tray opposite to the hinge, wherein the bracket abuts the upper screen plate surface.

8. A screen plate assembly for a pulp washer having a rotating cylindrical assembly of pulp trays, a housing having a header to direct pulp to the trays and at least one pulp wash stage, wherein the housing has at least one access port aligned with one or more of the trays, wherein the screen plate assembly comprises:

a screen plate adapted to seat in one of the pulp trays, wherein the screen plate has apertures sized to retain pulp fibers and allow liquid to pass through the plate, and a screen hinge attached to the screen plate and to the one of the trays, wherein the screen plate pivots about the hinge to allow a cleaning spray to be applied to an outer screen plate surface and a back screen plate surface while the screen plate remains attached to the one of the trays in the cylindrical assembly and in the housing.

9. The screen plate assembly of claim 8 wherein the screen hinge is attached to a side of each of the trays.

10. The screen plate assembly of claim 8 wherein the screen hinge is attached proximate to an edge of the screen plate.

11. The screen plate assembly of claim 10 wherein the edge of the screen plate extends a length of the screen plate.

12. The screen plate of claim 8 wherein the screen plate is supported by a plurality of ribs extending between a bottom surface of the tray and the back screen plate surface.

13. The screen plate of claim 8 further comprising bracing the screen plate with a stop piece at a side of the tray opposite to the hinge.

* * * * *